US005956050A

United States Patent [19]

Pickering et al.

[11] Patent Number: 5,956,050

[45] Date of Patent: Sep. 21, 1999

[54] MICROFLUIDIC PRINTING WITHOUT IMAGE REVERSAL

[75] Inventors: James E. Pickering, Holcomb; Werner Fassler, Rochester; Charles D. DeBoer, Palmyra, all of N.Y.

[73] Assignee: Eastman Kodak Company, Rochester, N.Y.

[21] Appl. No.: 08/901,180

[22] Filed: Jul. 28, 1997

[51] Int. Cl.[6] ..... B41J 13/02

[52] U.S. Cl. ..... 346/140.1; 347/8

[58] Field of Search ..... 346/140.1; 347/8

[56] References Cited

U.S. PATENT DOCUMENTS

| | | | |
|---|---|---|---|
| 4,485,387 | 11/1984 | Drumheller | 346/140.1 |
| 4,675,694 | 6/1987 | Bupara | 346/140.1 |
| 5,745,128 | 4/1998 | Lam et al. | 346/140.1 |

*Primary Examiner*—N. Le
*Assistant Examiner*—Lamson D. Nguyen
*Attorney, Agent, or Firm*—Raymond L. Owens

[57] ABSTRACT

A microfluidic printing apparatus including at least one ink reservoir; a moveable front plate of transparent material having a structure including a plurality of chambers arranged so that the chambers form an array which can be viewed by an observer, each such chamber being arranged to form an ink pixel; a plurality of microchannels connecting the reservoir to a chamber; a plurality of microfluidic pumps each being associated with a single microchannel for supplying ink from an ink reservoir through a microchannel for delivery to a particular chamber for viewing; apparatus for moving the front plate to a printing or ink disposal position; and apparatus for transferring the ink from the fill side of the chambers to a receiver when the front plate is in the printing position.

3 Claims, 6 Drawing Sheets

MICROFLUIDIC PRINTING WITHOUT IMAGE REVERSAL

CROSS REFERENCE TO RELATED APPLICATIONS

The present invention is related to U.S. patent application Ser. No. 08/868,426 filed Jun. 3, 1997, entitled "Continuous Tone Microfluidic Printing" to DeBoer, Fassler and Wen, Ser. No. 08/868,416 filed Jun. 3, 1997 entitled "Microfluidic Printing on Receiver", to DeBoer, Fassler and Wen, Ser. No. 08/868,102, filed Jun. 3, 1997 entitled "Microfluidic Printing with Ink Volume Control" to Wen, DeBoer and Fassler, Ser. No. 08/868,477, filed Jun. 3, 1997 entitled "Microfluidic Printing with Ink Flow Regulation" to Wen, Fassler and DeBoer, all assigned to the assignee of the present invention. The disclosure of these related applications is incorporated herein by reference.

FIELD OF THE INVENTION

The present invention relates to printing high quality images by microfluidic pumping of inks into receivers such as paper.

BACKGROUND OF THE INVENTION

Microfluidic pumping and dispensing of liquid chemical reagents is the subject of three U.S. Pat. Nos. 5,585,069, 5,593,838, and 5,603,351, all assigned to the David Sarnoff Research Center, Inc. The system uses an array of micron sized reservoirs, with connecting microchannels and reaction cells etched into a substrate. Electrokinetic pumps comprising electrically activated electrodes within the capillary microchannels provide the propulsive forces to move the liquid reagents within the system. The electrokinetic pump, which is also known as an electroosmotic pump, has been disclosed by Dasgupta et al., see "Electroosmosis: A Reliable Fluid Propulsion System for Flow Injection Analysis", Anal. Chem. 66, pp 1792–1798 (1994). The chemical reagent solutions are pumped from a reservoir, mixed in controlled amounts, and them pumped into a bottom array of reaction cells. The array may be decoupled from the assembly and removed for incubation or analysis. When used as a printing device, the chemical reagent solutions are replaced by dispersions of cyan, magenta, and yellow pigment, and the array of reaction cells may be considered a viewable display of picture elements, or pixels, comprising mixtures of pigments having the hue of the pixel in the original scene. When contacted with paper, the capillary force of the paper fibers pulls the dye from the cells and holds it in the paper, thus producing a paper print, or photograph, of the original scene. One problem with this kind of printer is the accurate control of the print density. The problem comes about because the capillary force of the paper fibers is strong enough to remove all the ink from the device, draining it empty. If the paper is not removed from contact with the ink cells at the correct time, the print density will be too high or too low. Moreover, the correct paper contact time varies with the ambient temperature, making the timing problem more difficult. One solution to this problem is given in the above mentioned copending application entitled "Microfluidic Printing on Receiver", where a special paper is employed which will absorb only a limited amount of ink. Nevertheless, it would be cheaper and simpler if plain paper can be employed for this kind of printing. Another solution to this problem is given in the above mentioned copending application entitled "Microfluidic Printing Array Valve", wherein an array of microvalves, each individually addressed, controls the flow of ink to the paper. The complexity of individually addressed valves leads to a high cost printing apparatus. In would be cheaper and easier to manufacture a device that did not have many individually addressed valves. In one configuration of the microfluidic printer, the image composed of pixels of ink before being transferred to the receiver is viewed before printing. A problem with this printer is that the viewed image is reversed from the printed image.

SUMMARY OF THE INVENTION

It is an object of this invention is to provide a microfluidic printer which can rapidly print high quality images on receivers such as plain paper with good control of the density and tone scale of the images.

Another object of this invention is to provide a compact, low power, portable printer.

Another object of this invention is to provide a viewable image that is not reversed when printed.

These objects are achieved by a microfluidic printing apparatus comprising:

a) at least one ink reservoir;

b) a moveable front plate of transparent material having a structure including a plurality of chambers arranged so that the chambers form an array which can be viewed by an observer, each such chamber being arranged to form an ink pixel;

c) a plurality of microchannels connecting the reservoir to a chamber;

d) a plurality of microfluidic pumps each being associated with a single microchannel for supplying ink from an ink reservoir through a microchannel for delivery to a particular chamber for viewing;

e) means for moving the front plate to a printing or ink disposal position ; and f) means for transferring the ink from the fill side of the chambers to a receiver when the front plate is in the printing position.

A feature of the present invention is that it provides apparatus which produces high quality prints of the correct density on plain paper.

Another feature of the invention is that the printer is low power, compact, and portable.

Another feature of the invention is that the printing process is fast, because all the pixels are printed simultaneously.

Another feature of the invention is that the image may be viewed before being printed.

Another feature of the invention is that there is no image reversal between the viewed and printed image.

DETAILED DESCRIPTION OF THE INVENTION

The present invention is described in relation to a microfluidic printing apparatus which can print computer generated images, graphic images, line art, text images and the like, as well as continuous tone images.

Figure 1:
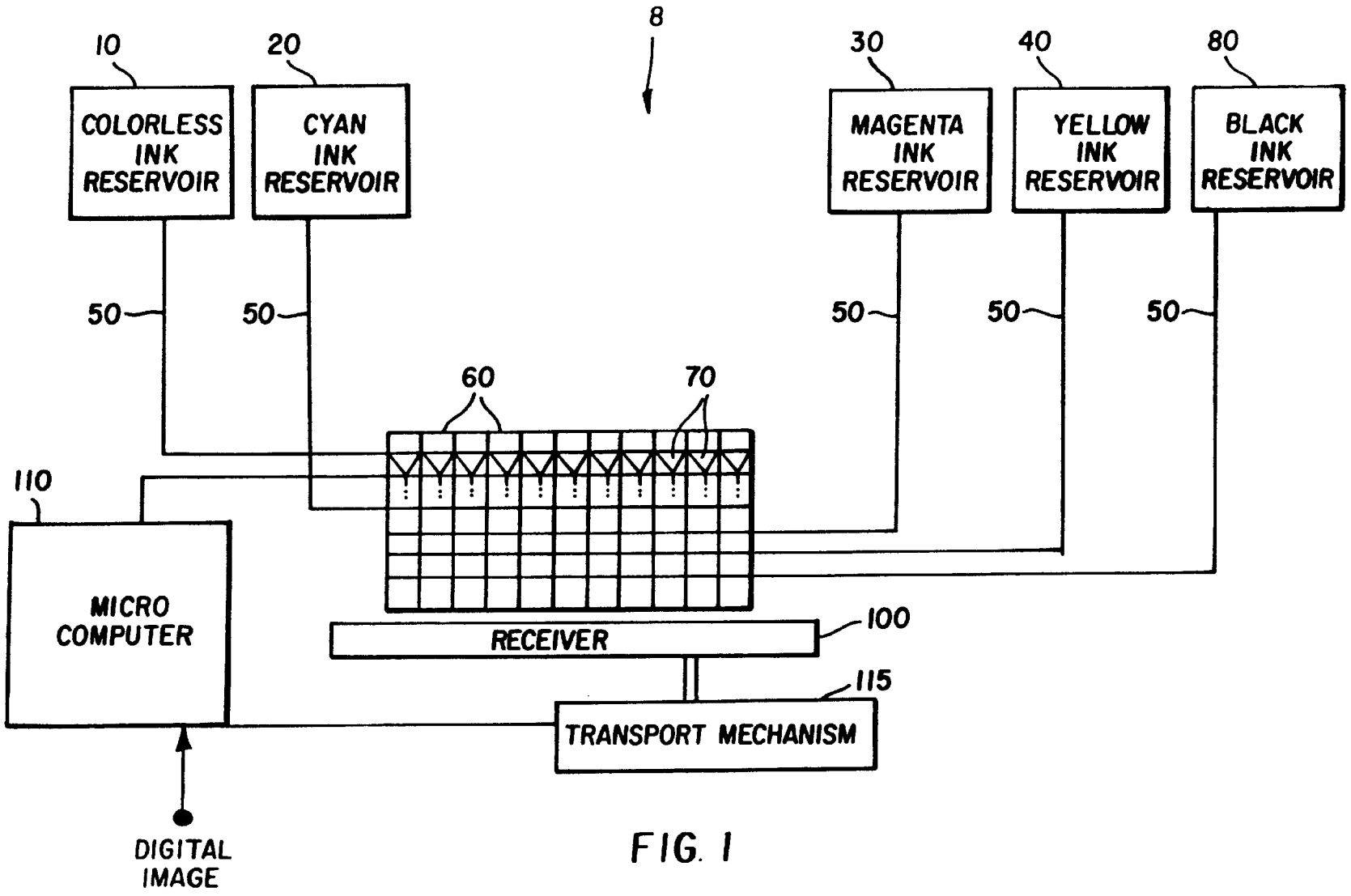
FIG. 1 is a partial schematic showing a microfluidic printing system for printing a digital image on a reflective receiver.

Referring to FIG. 1, a schematic diagram is shown of a printing apparatus 8 in accordance with the present invention. Reservoirs 20, 30, and 40 are respectively provided for holding cyan ink, magenta ink, and yellow ink. An optional reservoir 80 is shown for black ink. Microchannel capillaries 50 respectively connected to each of the reservoirs conduct ink from the corresponding reservoir to an array of ink chambers 60. In the present invention, the ink chambers 60 deliver the inks directly to a receiver; however, other types of ink delivery arrangements can be used such as microfluidic channels, and so when the word chamber is used, it will be understood to include those arrangements. The colored inks are delivered to ink chambers 60 by electrokinetic pumps 70. The amount of each color ink is controlled by microcomputer 110 according to the input digital image. For clarity of illustration, only one set of electrokinetic pumps is shown for the yellow ink channel. Similar pumps are used for the other color channels, but these are omitted from the figure for clarity. Finally, a reflective receiver 100 is transported by a transport mechanism 115 to come in contact with the microfluidic printing apparatus. The receiver 100 receives the ink and thereby produces the print. Receivers may include common bond paper, made from wood fibers, as well as synthetic papers made from polymeric fibers. In addition the receiver can be of non-fibrous construction, provided the receiver can absorb and hold the ink used in the printer.

Figure 2:
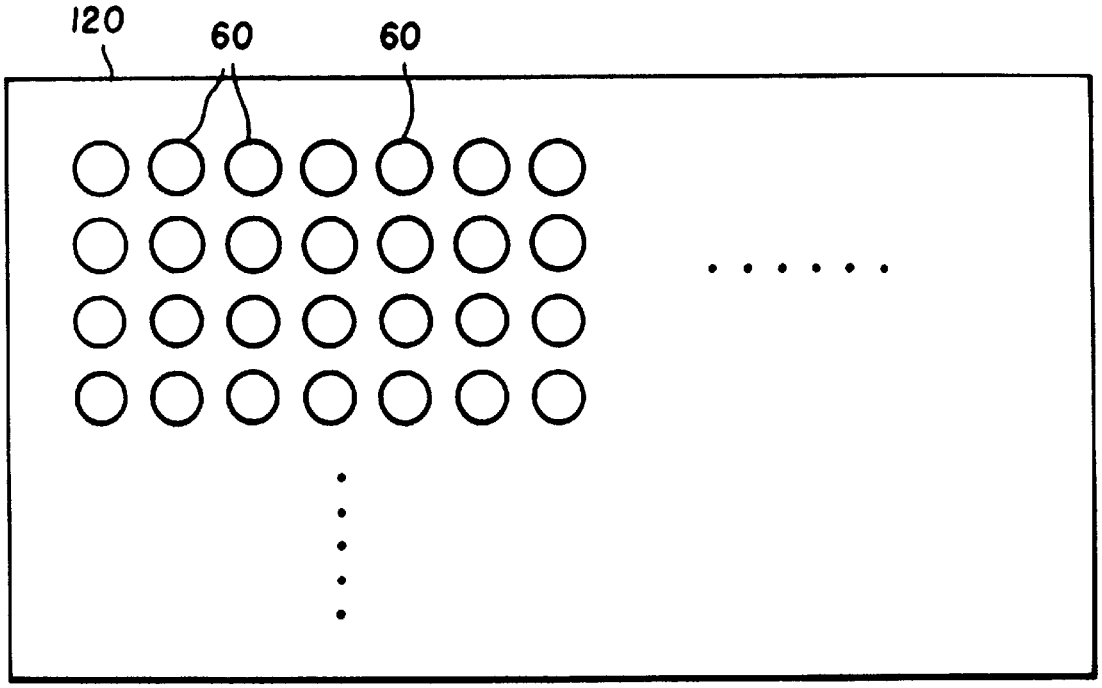
FIG. 2 is a top view of a pattern of the color pixels which can be produced by apparatus in accordance with the present invention.

FIG. 2 depicts a top view of an arrangement of chambers 60 shown in FIG. 1. Each ink chamber 60 is capable of producing a mixed ink having any color saturation and hue within the color gamut provided by the set of cyan, magenta and yellow inks used in the apparatus.

The inks used in this invention are dispersions of colorants in common solvents. Examples of such inks may be found is U.S. Pat. No. 5,611,847 by Gustina, Santilli and Bugner. Inks may also be found in the following commonly assigned U.S. patent application Ser. Nos. 08/699,955; 08/699,962 and 08/699,963 by McInerney, Oldfield, Bugner, Bermel and Santilli, and in U.S. patent application Ser. No. 08/790,131 by Bishop, Simons and Brick, and in U.S. patent application Ser. No. 08/764,379 by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention.

The microchannel capillaries, ink pixel chambers 60 and microfluidic pumps are more fully described in the references listed above.

Figure 3:
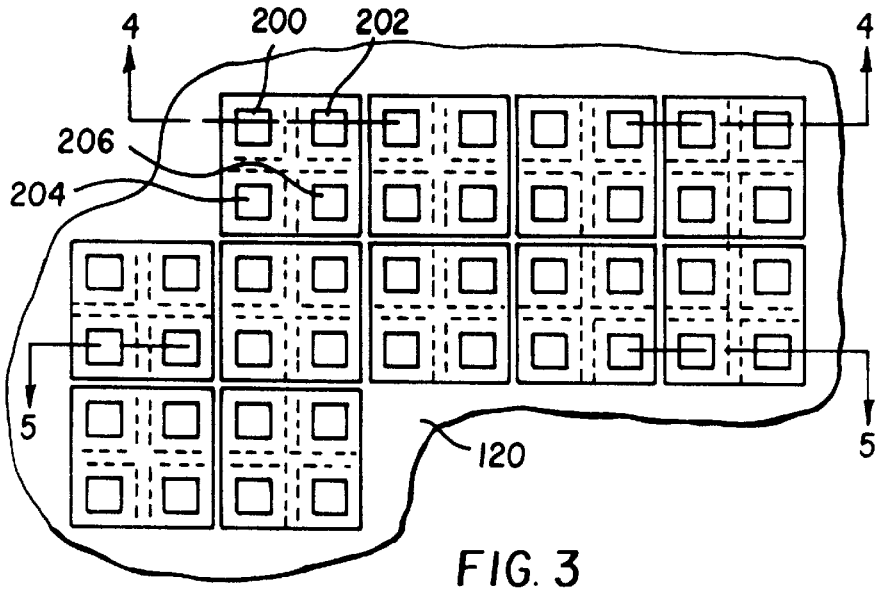
FIG. 3 is a top view of a second pattern of the color pixels which can be produced by apparatus in accordance with the present invention.

FIG. 3 illustrates the arrangement of a second pattern of color pixels in the present invention. The ink chambers 60 are divided into four groups cyan ink orifice 200; magenta ink orifice 202; yellow ink orifice 204; and black ink orifice 206. Each chamber 60 is connected only to the respective colored ink reservoir. When the inks are transferred to the reflective receiver 100 some of the inks can mix and blend on the receiver. Inasmuch as the inks are in distinct areas on the receiver, the size of the printed pixels should be selected to be small enough so that the human eye will integrate the color and the appearance of the image will be that of a continuous tone photographic quality image.

Figure 4:
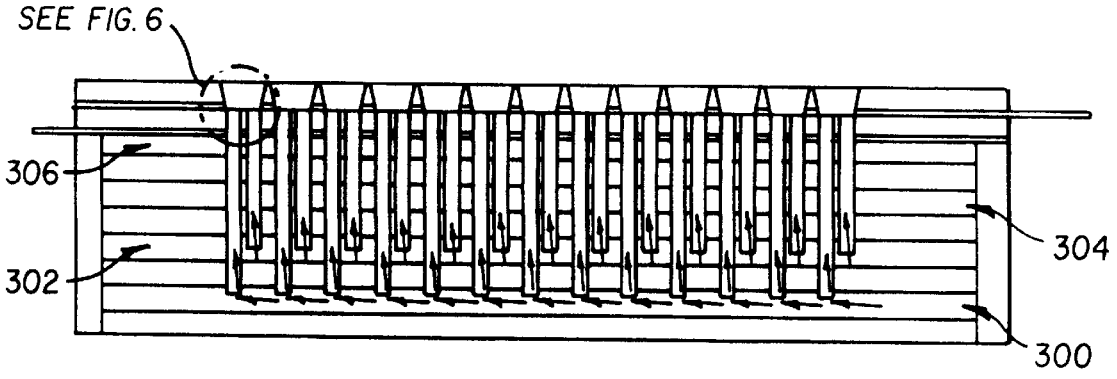
FIG. 4 is a cross-sectional view taken along the lines 4—4 of the microfluidic printing apparatus in FIG. 3.
Figure 5:
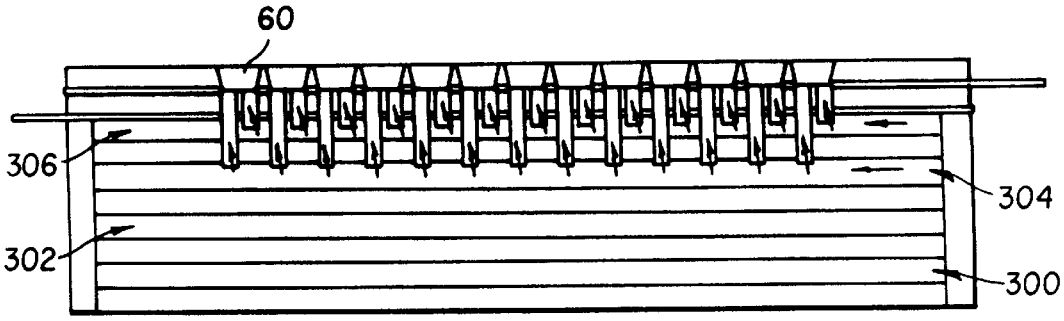
FIG. 5 is another cross-sectional taken along the lines 5—5 of the microfluidic printing apparatus in FIG. 3.

Cross-sections of the color pixel arrangement shown in FIG. 3 are illustrated in FIG. 4 and FIG. 5. The colored ink supplies 300, 302, 304, and 306 are fabricated in channels parallel to the removable printer front plate 120. The cyan, magenta, yellow and black inks are respectively delivered by colored ink supplies 300, 302, 304, and 306 into each of the colored ink chambers 60.

Figure 6:
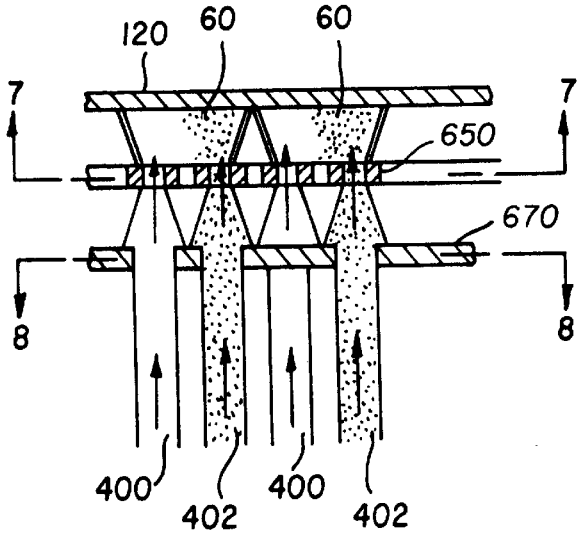
FIG. 6 is an enlarged view of the circled portion of FIG. 4.

A detailed view of the cross-section in FIG. 4 is illustrated in FIG. 6. The colored inks are delivered to the ink chambers 60 respectively by cyan, magenta, yellow, and black ink microchannels 400, 402, 404, and 406. (404 and 406 do not show up in the plan shown in FIG. 6, but is illustrated in FIG. 8) The colored ink microchannels 400, 402, 404, and 406 are respectively connected to the colored ink supplies 300, 302, 304, and 306 (FIGS. 4 and 5).

Figure 7:
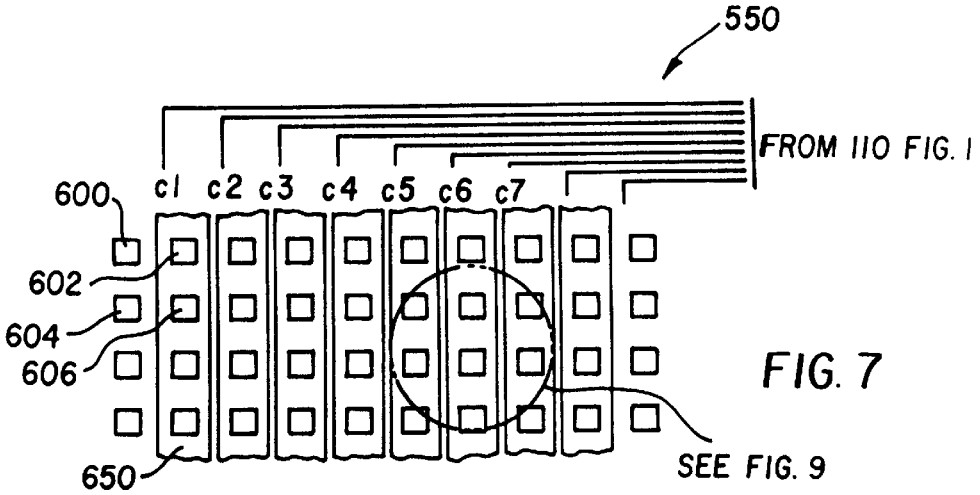
FIG. 7 is a top view of the micronozzles shown in FIG. 6.

A cross-section view of the plane containing the micronozzles in FIG. 6 is shown in FIG. 7. The cyan, magenta, yellow, and black ink micronozzles 600, 602, 604, and 606 are distributed in the same arrangement as the colored ink supply lines 300–304 and the termination of the chambers 60 which are colored ink orifices 200–206. The column electrodes 650 are shown connected to the conducting circuit 550, which is further connected to microcomputer 110.

Figure 8:
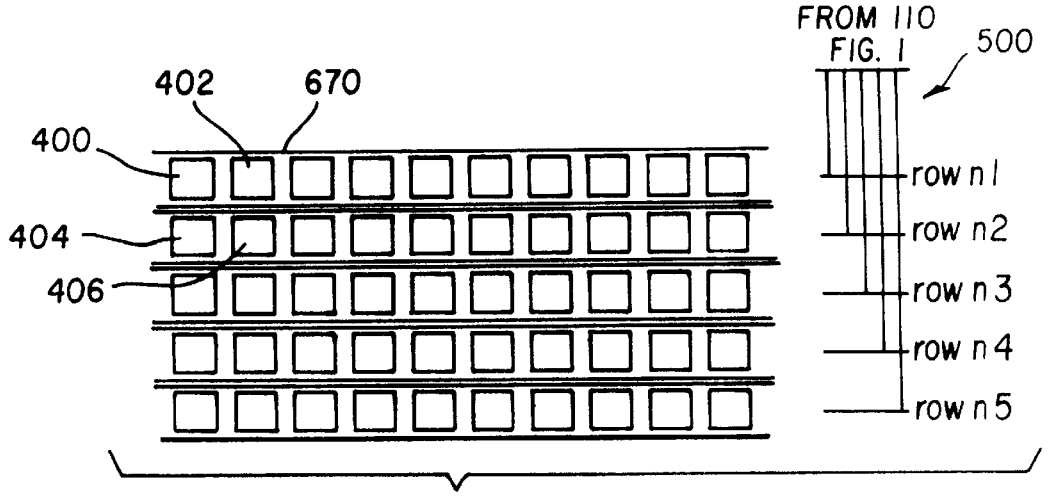
FIG. 8 is a top view of the microchannel and showing conducting circuit connections in FIG. 6.

A cross-section view of the plane containing the microchannels 400, 402, 404, and 406 in FIG. 6 is shown in FIG. 8. The color ink channels 400–406 are laid out in the spatial arrangement that corresponds to those in FIGS. 3 and 7. The lower electrodes in the electrokinetic pumps for delivering the colored inks are not shown for clarity of illustration. The row electrodes 670 are connected to lower electrodes of the electrokinetic pumps. The row electrodes 670 are shown connected to the conducting circuit 500, which is further connected to microcomputer 110.

The operation of a microfluidic printer comprises the steps of activating the electrokinetic pumps to pump the correct amount of each color ink to the chamber 60 to provide a pixel of the correct hue and intensity corresponding to the pixel of the scene being printed. The removable printer front plate 120 preferable backed by a white reflecting material so that the ink chambers 60 which correspond to the pixels of the image render an accurate impression of the image when viewed by the operator. After viewing the image, the operator may desire to make a correction in the image. For example, if the overall image was deficient in yellow, more yellow ink might be pumped into the ink chambers. After the image is viewed and corrected and a print is desired, the removable printer front plate is separated from the ink supply microchannels 300, 302, 304, and 306 and placed in contact with the receiver. The capillary forces of the receiver fibers draw the ink from the ink chambers into the receiver, completing the printing operation. It should be noted that the ink must be transferred from the fill side of the ink chambers to the receiver if the viewed and printed image are both to be right reading, if the receiver is of the kind where the ink is viewed on the side it is printed.

Figure 9:
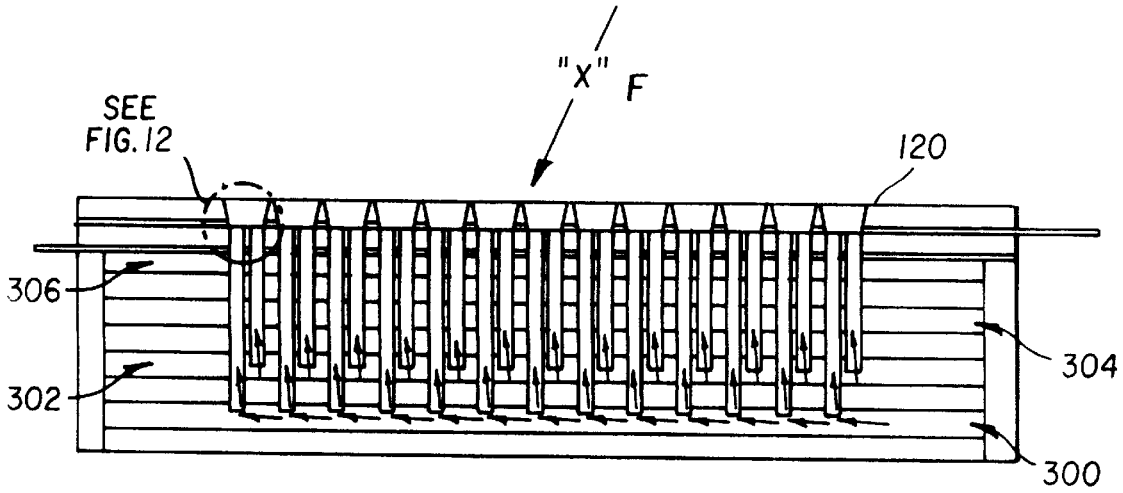
FIG. 9 is a diagram illustrating the method of viewing the image before it is printed.

FIG. 9 illustrates the removable printer front plate in the viewing mode, as indicated by the viewing direction "x", where the ink chambers are in contact with the ink supply lines 300, 302, 304, and 306. The image as viewed is right reading, as indicated by the letter "F".

Figure 10:
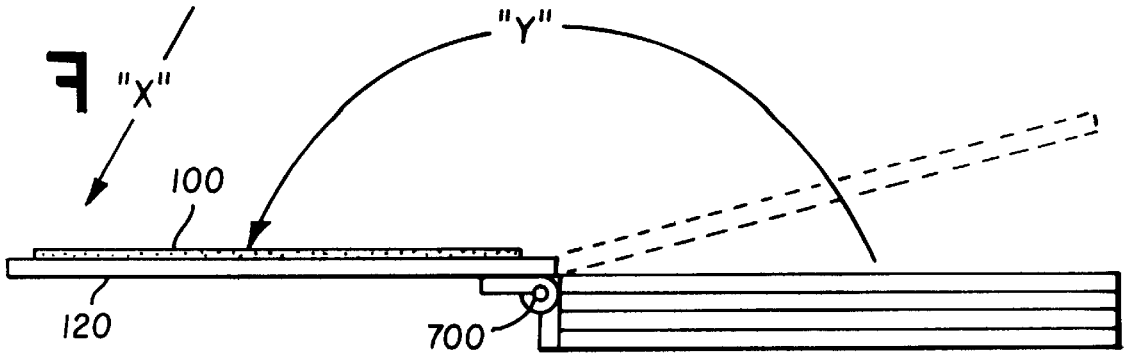
FIG. 10 is a diagram illustrating the separation of the viewed image from the printing apparatus.

FIG. 10 illustrates one method of separation of the removable printer front plate 120 by swinging through the radius "y" from the ink supply lines wherein the removable printer front plate 120 is attached to the rest of the assembly on one side by a hinge 700. Note that the image as viewed in the direction "x" on the open removable printer front plate 120 is reversed, as indicated by the reversed letter "F".

Figure 11:
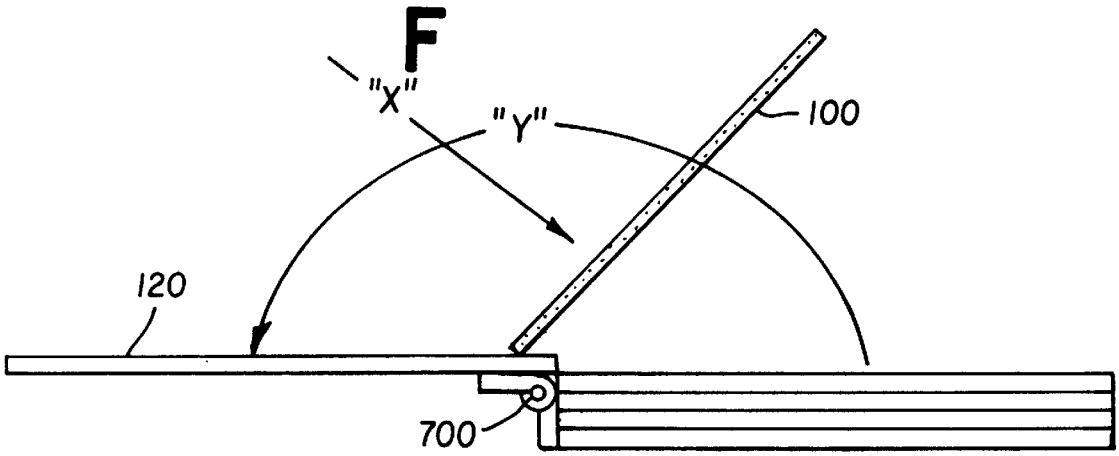
FIG. 11 is a diagram illustrating the printing of the viewed image onto the image receiver.

FIG. 11 illustrates the transfer of the ink from the ink chambers 60 to the receiver 100 and removal of the receiver from the printing plate 120, thus completing the printing process. It should be noted that both the printed image indicated by the direction "x" is right reading and not reversed, as indicated by the letter "F".

Figure 12:
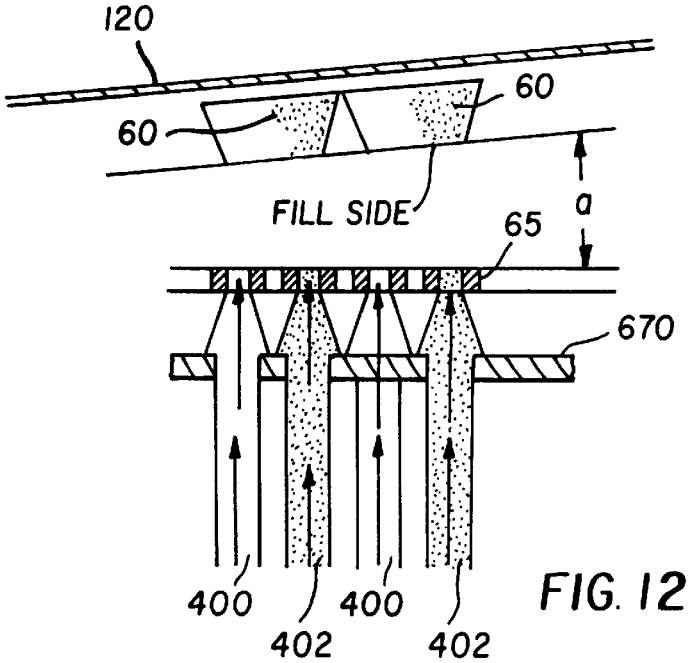
FIG. 12 is an enlarged view of FIG. 9 showing the filling side of the ink chambers.

FIG. 12 is an enlargement of the circled area of FIG. 9, showing the details of the separation of the removable printer front plate 120 which contains the ink chambers 60. In FIG. 12 the removable printer front plate 120 is partially separated from the rest of the assembly as indicated by the distance "a".

The invention has been described in detail with particular reference to certain preferred embodiments thereof, but it will be understood that variations and modifications can be effected within the spirit and scope of the invention.

PARTS LIST

8 microfluidic printing system
20 cyan ink reservoir
30 magenta ink reservoir
40 yellow ink reservoir
50 microchannel capillaries
60 ink chambers, or printing nozzles
70 electrokinetic pumps
80 black ink reservoir
100 receiver
110 microcomputer
115 transport mechanism
120 removable printer front plate
130 ink supply plate
200 colored ink orifices
202 colored ink orifices
204 colored ink orifices
206 colored ink orifices
300 colored ink supply lines
302 colored ink supply lines
304 colored ink supply lines
306 black ink supply
400 cyan ink microchannel
402 magenta ink microchannel
404 yellow ink microchannel
406 black ink microchannel
500 conducting circuit
550 conducting circuit
600 cyan ink micro-orifice
602 magenta ink micro-orifice
Parts List cont'd
604 yellow ink micro-orifice
606 black ink micro-orifice
650 column electrodes
670 row electrodes
700 hinge

What is claimed is:

1. A microfluidic printing apparatus comprising:

a) at least one ink reservoir;

b) a removeable front plate of transparent material having a structure including a plurality of chambers arranged so that the chambers form an array which can be viewed by an observer, each such chamber being arranged to form an ink pixel;

c) a plurality of microchannels connecting the reservoir to a chamber;

d) a plurality of microfluidic pumps each being associated with a single microchannel for supplying ink from an ink reservoir through a microchannel for delivery to a particular chamber for viewing;

e) means for moving the removable front plate to a printing position; and f) means for transferring the ink from the fill side of the chambers to a receiver when the front plate is in the printing position.

2. A microfluidic printing apparatus comprising:

a) at least one ink reservoir;

b) a moveable front plate of transparent material having a structure including a plurality of chambers arranged so that the chambers form an array which can be viewed by an observer, each such chamber being arranged to form an ink pixel;

c) a plurality of microchannels connecting the reservoir to a chamber;

d) a plurality of microfluidic pumps each being associated with a single microchannel for supplying ink from an ink reservoir through a microchannel for delivery to a particular chamber for viewing;

e) means for adding ink to the chambers to make the viewed image right reading to the observer; and f) means for moving the front plate to a printing or ink disposal position; and g) means for transferring the ink from the fill side of the chambers to a receiver when the front plate is in the printing position.

3. The printing apparatus of claim 2 wherein the removable front plate is pivotably mounted and can be moved between the viewing and printing positions.

* * * * *

UNITED STATES PATENT AND TRADEMARK OFFICE

CERTIFICATE OF CORRECTION

PATENT NO. : 5,956,050
APPLICATION NO. : 08/901180
DATED : September 21, 1999
INVENTOR(S) : James E. Pickering et al.

It is certified that error appears in the above-identified patent and that said Letters Patent is hereby corrected as shown below:

Col. 6 Insert

Claim 1 1. A microfluidic printing apparatus comprising:

a) at least one ink reservoir;

b) a removeable front plate of transparent material having a structure including a plurality of chambers arranged so that the chambers form an array which can be viewed by an observer, each such chamber being arranged to form an ink pixel;

c) a plurality of microchannels connecting the ink reservoir to said each chamber;

d) a plurality of microfluidic pumps each being associated with a single microchannel of said plurality of microchannels for supplying ink from the ink reservoir through the single microchannel for delivery to a particular chamber of said plurality of chambers for viewing an image;

e) means for moving the removable front plate to a printing position ; and f) means for transferring the ink from said plurality of chambers to a receiver when the front plate is in the printing position.

Col. 6 Insert

Claim 2 2. A microfluidic printing apparatus comprising:

a) at least one ink reservoir;

UNITED STATES PATENT AND TRADEMARK OFFICE

CERTIFICATE OF CORRECTION

PATENT NO. : 5,956,050
APPLICATION NO. : 08/901180
DATED : September 21, 1999
INVENTOR(S) : James E. Pickering et al.

It is certified that error appears in the above-identified patent and that said Letters Patent is hereby corrected as shown below:

Claim 2 (cont'd)

b) a moveable front plate of transparent material having a structure including a plurality of chambers arranged so that the chambers form an array which can be viewed by an observer, each such chamber being arranged to form an ink pixel;

c) a plurality of microchannels connecting the ink reservoir to said each chamber;

d) a plurality of microfluidic pumps each being associated with a single microchannel of said plurality of microchannels for supplying ink from the ink reservoir through the single microchannel for delivery to a particular chamber of said plurality of chambers for viewing an image;

e) means for adding ink to the said plurality of chambers to make the viewed image right reading to the observer at a viewing position; and f) means for moving the removable front plate to a printing or ink disposal position; and

UNITED STATES PATENT AND TRADEMARK OFFICE

CERTIFICATE OF CORRECTION

PATENT NO. : 5,956,050
APPLICATION NO. : 08/901180
DATED : September 21, 1999
INVENTOR(S) : James E. Pickering et al.

It is certified that error appears in the above-identified patent and that said Letters Patent is hereby corrected as shown below:

Claim 2 (cont'd)

g) means for transferring the ink from said plurality of chambers to a receiver when the removable front plate is in the printing position.

Signed and Sealed this

Twenty-seventh Day of November, 2007

JON W. DUDAS
*Director of the United States Patent and Trademark Office*